US006855013B2

(12) United States Patent
Chiang et al.

(10) Patent No.: US 6,855,013 B2
(45) Date of Patent: Feb. 15, 2005

(54) LCD CONNECTOR FOR PRINTED CIRCUIT BOARDS

(75) Inventors: Michael Chung-Ta Chiang, Houston, TX (US); Steven Walker Knoernschild, Maumelle, AR (US); Stanley Earl Starnes, Olive Branch, MS (US); Hesham K. Elkhatib, Naperville, IL (US); Dale Alan Weber, Mission Viejo, CA (US)

(73) Assignee: Tyco Electronic Logistics AG (CH)

( * ) Notice: Subject to any disclaimer, the term of this patent is extended or adjusted under 35 U.S.C. 154(b) by 352 days.

(21) Appl. No.: 09/850,206

(22) Filed: May 7, 2001

(65) Prior Publication Data

US 2002/0115352 A1 Aug. 22, 2002

Related U.S. Application Data

(60) Provisional application No. 60/203,239, filed on May 8, 2000, provisional application No. 60/203,242, filed on May 8, 2000, provisional application No. 60/202,400, filed on May 8, 2000, and provisional application No. 60/202,399, filed on May 8, 2000.

(51) Int. Cl.[7] ..... H01R 12/00
(52) U.S. Cl. ..... 439/862; 439/736; 439/741
(58) Field of Search ..... 439/66, 862, 736, 439/741

(56) References Cited

U.S. PATENT DOCUMENTS

| | | | | |
|---|---|---|---|---|
| 3,178,669 | A | | 4/1965 | Roberts |
| 3,207,832 | A | | 9/1965 | Patti et al. |
| 3,284,258 | A | | 11/1966 | Patti et al. |
| 3,313,874 | A | | 4/1967 | Bleinberger et al. |
| 3,512,121 | A | | 5/1970 | Bergeron |
| 3,601,751 | A | | 8/1971 | Pauza |
| 3,634,601 | A | | 1/1972 | Pauza |
| 3,636,503 | A | | 1/1972 | Bernutz et al. |
| 3,665,376 | A | | 5/1972 | Paris et al. |
| 3,815,077 | A | * | 6/1974 | Anhalt et al. |
| 3,970,351 | A | | 7/1976 | Hollingsead et al. |
| 4,114,976 | A | | 9/1978 | Selvin et al. |
| 4,232,923 | A | | 11/1980 | Otsuki et al. |
| RE31,142 | E | | 2/1983 | Simmons |
| 4,410,232 | A | | 10/1983 | Murray |
| 4,495,130 | A | | 1/1985 | Hedrick |
| 4,712,850 | A | * | 12/1987 | Seidler ..... 439/861 |
| 4,738,625 | A | * | 4/1988 | Burton et al. |
| 5,030,107 | A | | 7/1991 | Moon |
| 5,108,317 | A | | 4/1992 | Beinhaur et al. |
| 5,288,235 | A | | 2/1994 | Sobhani |
| 5,372,512 | A | | 12/1994 | Wilson et al. |
| 5,427,535 | A | | 6/1995 | Sinclair |
| 5,709,576 | A | | 1/1998 | Lippmann et al. |
| 5,744,759 | A | | 4/1998 | Ameen et al. |
| 5,759,047 | A | | 6/1998 | Brodsky et al. |
| 5,759,049 | A | | 6/1998 | Gerber |
| 5,868,582 | A | | 2/1999 | Jacobi |

(List continued on next page.)

*Primary Examiner*—Neil Abrams
(74) *Attorney, Agent, or Firm*—Hoffmann & Baron, LLP

(57) ABSTRACT

An electrical connector for establishing electrical connection between a conductive portion of an LCD display and conductive elements of a printed circuit board comprises a substantially planar insulative connector housing and a plurality of electrical contacts supported thereby. Each contact includes a deflectable spring-like portion for resilient engagement with the LCD display and a tail portion for conductive engagement with the printed circuit board. Each contact further includes therebetween a mid-section secured to the insulative housing. The contacts are supported in the housing in laterally spaced disposition with respect to each other, and are adapted to provide sufficient normal forces to maintain sufficient mechanical and electrical connection between the connector and each of an LCD display and a printed circuit board. Contact free ends may be captured in a slot in the housing and the housing may include a flexible extent to provide increased contact pressure upon mating.

13 Claims, 21 Drawing Sheets

U.S. PATENT DOCUMENTS 5,879,169 A * 3/1999 Wu ..... 439/74
5,888,076 A 3/1999 Itoh et al.
5,980,323 A * 11/1999 Bricaud et al. ..... 439/630
6,025,996 A * 2/2000 Vacheron ..... 439/83
6,027,381 A * 2/2000 Lok ..... 439/736
6,129,558 A * 10/2000 Kihira et al. ..... 439/66
6,142,790 A * 11/2000 Niitsu ..... 439/682
6,287,151 B1 * 9/2001 Matsuzaki ..... 439/630

* cited by examiner

LCD CONNECTOR FOR PRINTED CIRCUIT BOARDS

The present application claims priority to U.S. Provisional Application No. 60/203,239, filed May 8, 2000 entitled "LCD Connector Having Integrated Preload Feature"; U.S. Provisional Application No. 60/203,242, filed May 8, 2000 entitled "LCD Surface Mount Connector; U.S. Provisional Application No. 60/202,400, filed May 8, 2000 entitled "LCD Connector with Flexible Leaf-Spring Housing"; and U.S. Provisional Application No. 60/202,399 filed May 8, 2000 entitled "LCD Connector with Metallic Spring Contacts".

FIELD OF THE INVENTION

This invention is directed to the manufacture of a connector for liquid crystal displays ("LCDs") that is adapted for electrical connection of an LCD panel and a conductive portion of a printed wiring board (PWB) or printed circuit board (PCB). This invention is further directed to a method of affixing an LCD panel to a PWB or PCB through an insulative connector having a plurality of contacts mounted thereon. As used herein, the terms PWB and PCB will be used interchangeably to denote a substrate having conductive elements to which an LCD is electrically connected.

BACKGROUND OF THE INVENTION

Liquid crystal displays ("LCDs") are being aggressively integrated into a multitude of contemporary electronic devices that previously employed cathode ray tubes (CRTs). "Liquid crystal" is a term that indicates the status of a substance that is neither solid nor liquid. When coming into contact with a grooved surface in a fixed direction, liquid crystal molecules line up in parallel along the grooves. Light travels through the spacing of the molecular arrangement. As the molecule arrangement is twisted, the light also "twists" as it passes through the liquid crystals. When a voltage is applied to the liquid crystal structure, the molecules rearrange themselves and the twisted light passes straight through. When voltage is applied to a combination of two polarizing filters and twisted liquid crystal, it becomes an LCD display. This is the principle behind conventional twisted nematic (TN) LCDs.

It is desirable to exploit the unique advantages of LCD displays, such as their compact size, thin profile, lightweight, low power consumption and ability to withstand elevated temperatures and vibrations, to produce items that are more compact and lightweight than CRTs. This means that LCDs can be used in many applications where a large CRT monitor does not fit or is impractical. Such products include LCD TVs, view cams, portable information tools (i.e. PDAs), computer monitors, A/V equipment, car navigation systems, game devices, large projection TVs and similar products. LCDs also deliver comparable performance in the display of color, resolution and brightness and further obviate the emission of harmful radiation attributable to emission by CRT monitors.

The typical LCD module includes a liquid crystal matrix mounted in or to a substrate that includes a plurality of discrete conductive regions disposed thereon. A liquid crystal cell is acquired by forming the requisite electrodes and then forming an alignment layer within which liquid crystal particles align themselves. Upper and lower glass substrates are thereafter coupled to one another and plastic beads are sandwiched therebetween. The substrates are then fixed, after which liquid crystals are injected into spaces between the plastic beads. Sealing of the LCD module is completed when external electronic elements, along with a driver, are connected to the electrodes of the finished cell.

Elastomeric connectors effect the most common method of connection of LCD modules to the conductive portion of a printed wiring board (PWB) or printed circuit board (PCB). Such connectors are generally silicone rubber strips made up of sequentially spaced conductive and non-conductive materials. Typical elastomeric connectors have at least one row of alternating layers of conductive and insulative compressible material that may be surrounded on its sides by a rubber supporting layer. The elastomeric connector is used in assemblies by mechanically confining the connector sides and compressing the connector through its height, thereby pressing the conductive elements in the connector onto conductive pads on the PWB and corresponding conductive pads on the LCD.

Increasing use of LCDs in delicate and complex electronic devices, however, increases the number of applications in which numerous interconnections must be made between the LCD and the PWB. Since there is limited space for these connections, it is imperative that the LCD pads and the PWB pads be tightly aligned over one another and that there be minimal angular skew in the conductive elements in the elastomer. This angle therefore becomes particularly important as the height of the connector increases. Absent such precise configuration, the conductors in the connector might not connect to the appropriate corresponding pads on the LCD and the PWB. In addition, since the connector is made from a rubbery material that is susceptible to movement under elevated temperature and vibrations, the retention of the elastomeric connectors to the PCB is minimal.

It is therefore desirable to provide an LCD surface mount connector that overcomes the problems inherent in elastomeric connectors. Particularly, it is desirable to provide such a connector that predictably and reliably retains conductive elements in precise alignment with one another.

SUMMARY OF THE INVENTION

It is therefore an advantage of the present invention to provide an improved LCD surface mount connector that obviates the above-described shortcomings of conventional elastomeric contacts.

It is another advantage of the present invention to provide an LCD surface mount connector that retains a plurality of contacts in an inexpensively molded insulative housing.

It is an additional advantage of the present invention to ensure that conductive elements of an LCD connector are correctly aligned with terminal pads of adjacent circuits during assembly of the connector between the circuits.

In accordance therefor with a particular arrangement of the invention, an electrical connector is provided for establishing electrical connection between a conductive portion of an LCD display and conductive elements of a printed circuit board. The connector includes a substantially planar integrally formed connector housing supportable on the printed circuit board, the housing having an upper surface, a lower surface and a peripheral wall. A plurality of electrical contacts are supported by the housing, each contact including an interior contact extent having a deflectable spring-like portion defined thereat. The interior contact extent provides for electrical engagement with the LCD conductor portion. Each electrical contact includes an exterior contact extent for termination to the printed circuit board. Each contact further includes a mid-section extent between the interior contact extent and the exterior contact extent, the midsection contact extents being secured to the housing allowing free connection of the interior contact extent to the printed circuit board and deflectable connection of the interior contact extent to the LCD conductor portions.

DETAILED DESCRIPTION OF THE PREFERRED EMBODIMENTS

The present invention provides for an LCD surface mount connector that eliminates the angular skew and consequential connection problems that are inherent in conventional elastomeric connectors. In one arrangement of the present invention shown with respect to FIGS. 1–11, the connector utilizes a plurality of contacts of varying configuration that are laterally spaced in an insulative connector housing. The contacts have resilient undulation spring-like portions at an extent thereof protruding normally from the housing and a tail portion for termination with a PWB. The contacts are fabricated for easy coupling with the housing wherein coupling effects alignment of the contacts and ensures proper mechanical and electrical engagement between the contacts and corresponding pads on the conductive portions of the LCD and the PWB.

Figure 1:
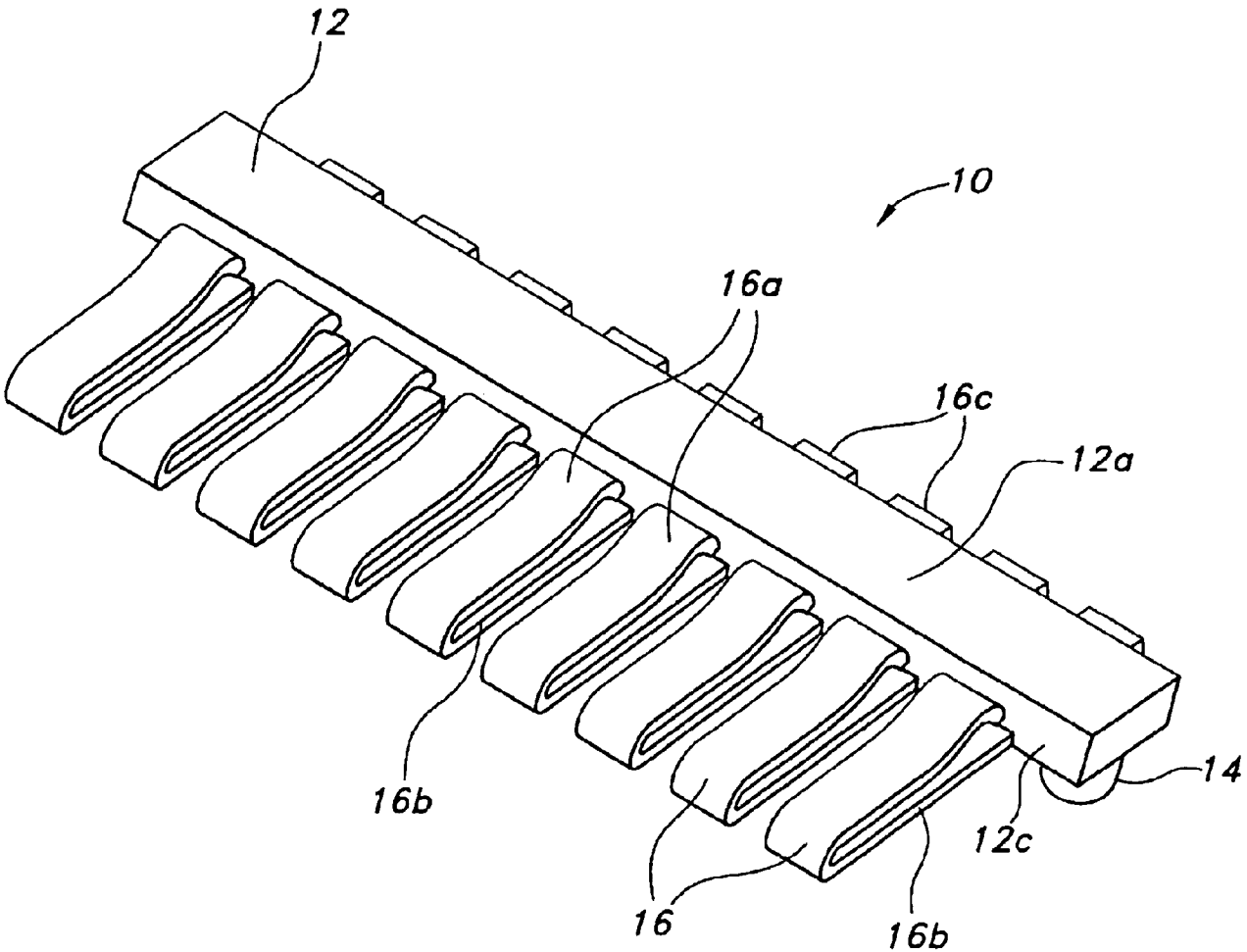
FIG. 1 shows a top perspective view of one embodiment of an LCD surface mount connector of the present invention.
Figure 2:
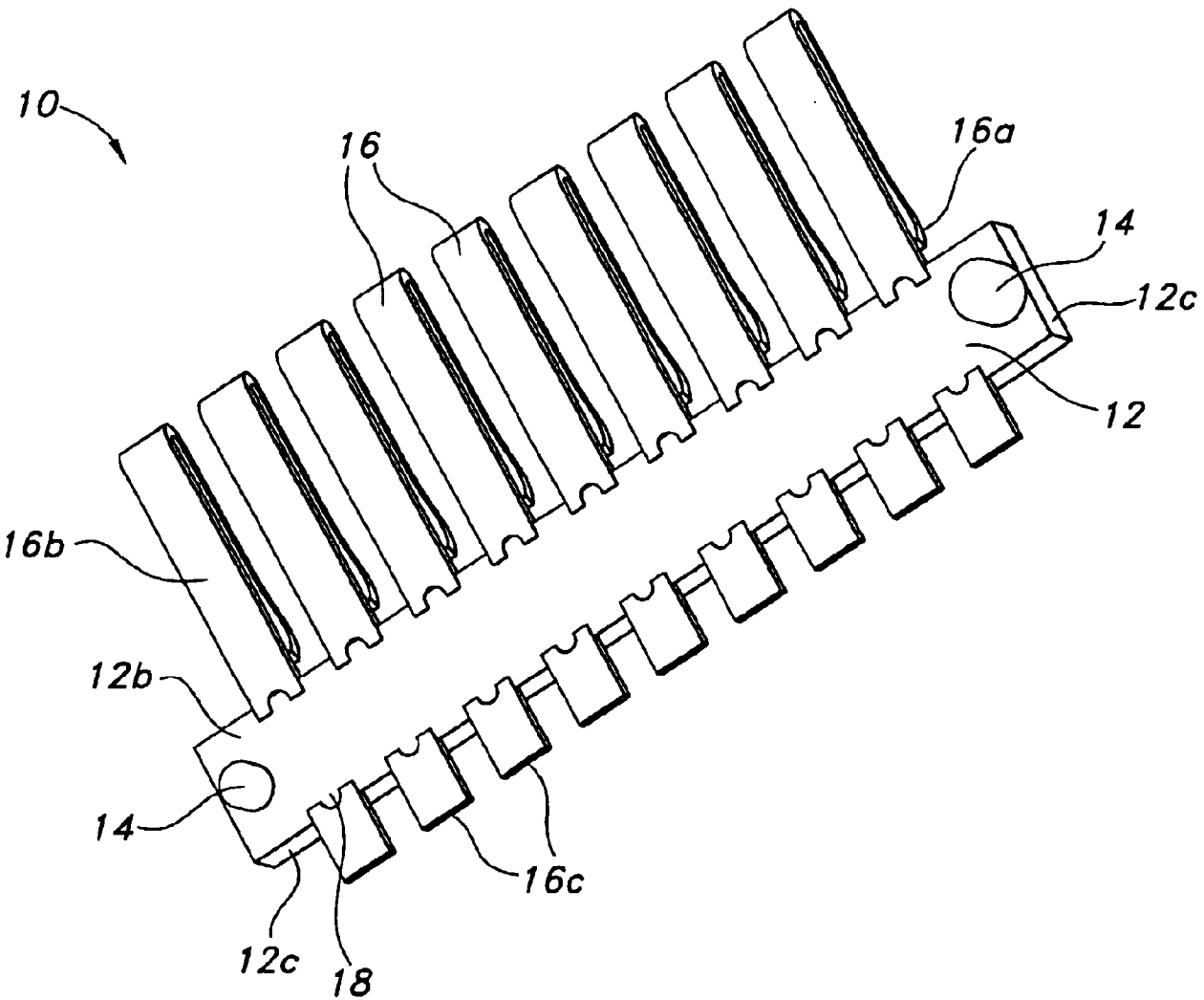
FIG. 2 shows a bottom perspective view of the LCD surface mount connector of FIG. 1.

Now referring to the drawing figures, FIGS. 1 and 2 show an LCD surface mount connector 10 in accordance with a particular arrangement of the present invention. Connector 10 includes a pier 12 having a top planar surface 12*a*, a bottom planar surface 12*b* and a peripheral side wall 12*c* extending therebetween. Connector 10 further includes one or more securement members 14 protruding normally from bottom surface 12*b* to effect securement of connector 10 to a correspondingly configured aperture in a PWB. Pier 12 is desirably fabricated from an insulative plastic which is easily molded such as by RTM or injection molding processes.

Pier 12 supports a plurality of laterally spaced contacts 16 thereby. Each contact 16 is provided in a clothespin-type configuration wherein a spring-like undulation 16*a* lies in parallel spaced relation to a substantially planar base 16*b*. Each contact 16 further includes a tail portion 16*c* that protrudes from a portion of side wall 12*c* opposite that from which base 16 extends.

Figure 3:
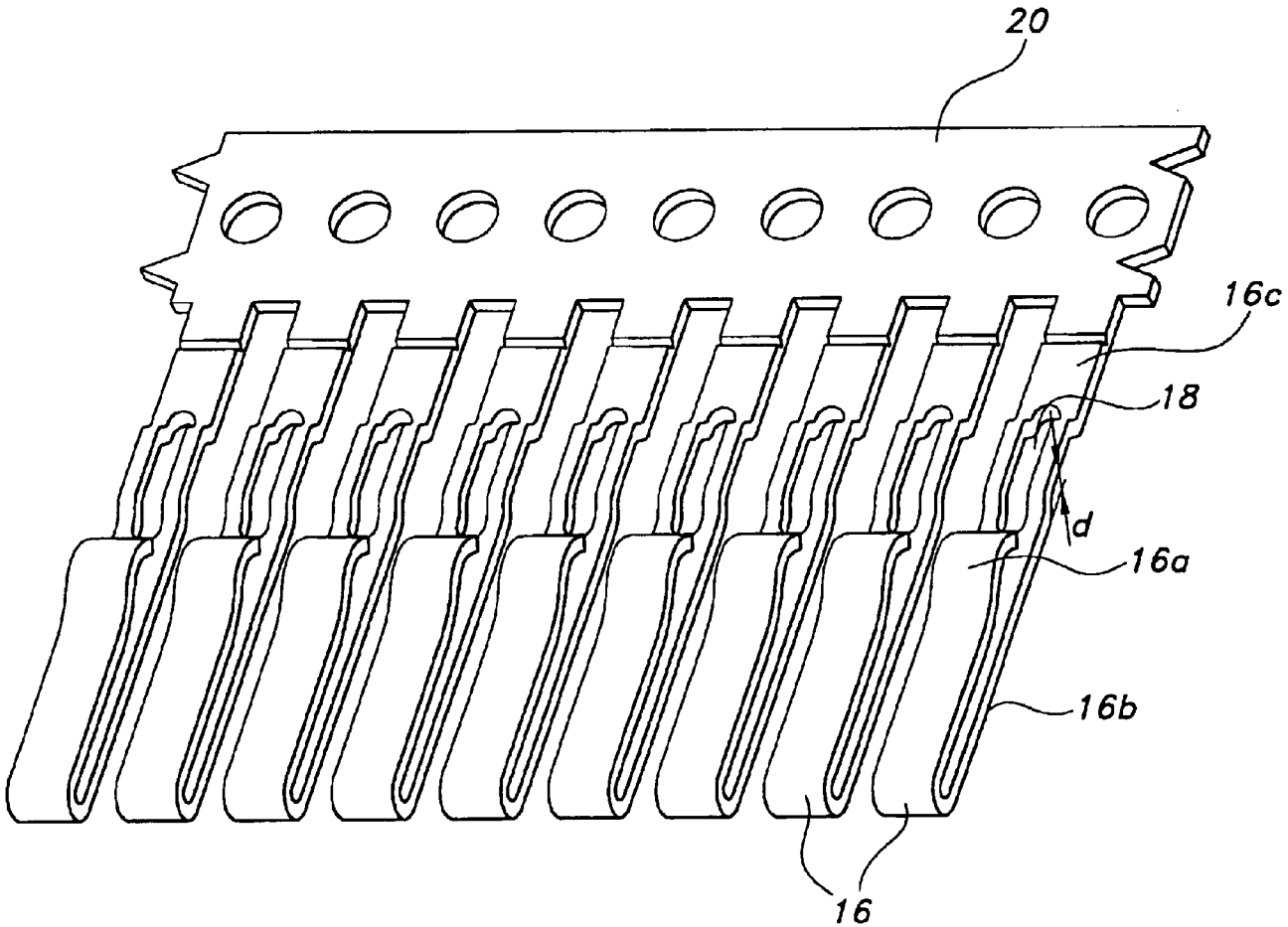
FIG. 3 shows a top perspective view of a plurality of contacts employed in the connector of FIGS. 1 and 2 prior to an insert molding operation.

As further shown in FIG. 3, each contact 16 has a slot 18 defined therewithin. Contacts 16 are shown while still attached to a common ribbon 20 of a conductive metal from which contacts 16 are stamped. Slots 18 are elevated by a distance d above a plane in which base 16*b* lies, however it is understood that such distance d is mutable to accommodate the performance requirements of the connector. Distance d provides sufficient elevation to enable plastic flow of the insulative material of pier 12 to flow through slots 18 during an insert molding operation. Contacts 16 are thereby retained in alignment relative to one another and relative to pier 12 so as to effect sufficient aligned connection with requisite conductive elements on the LCD display and the PWB.

Figure 4:
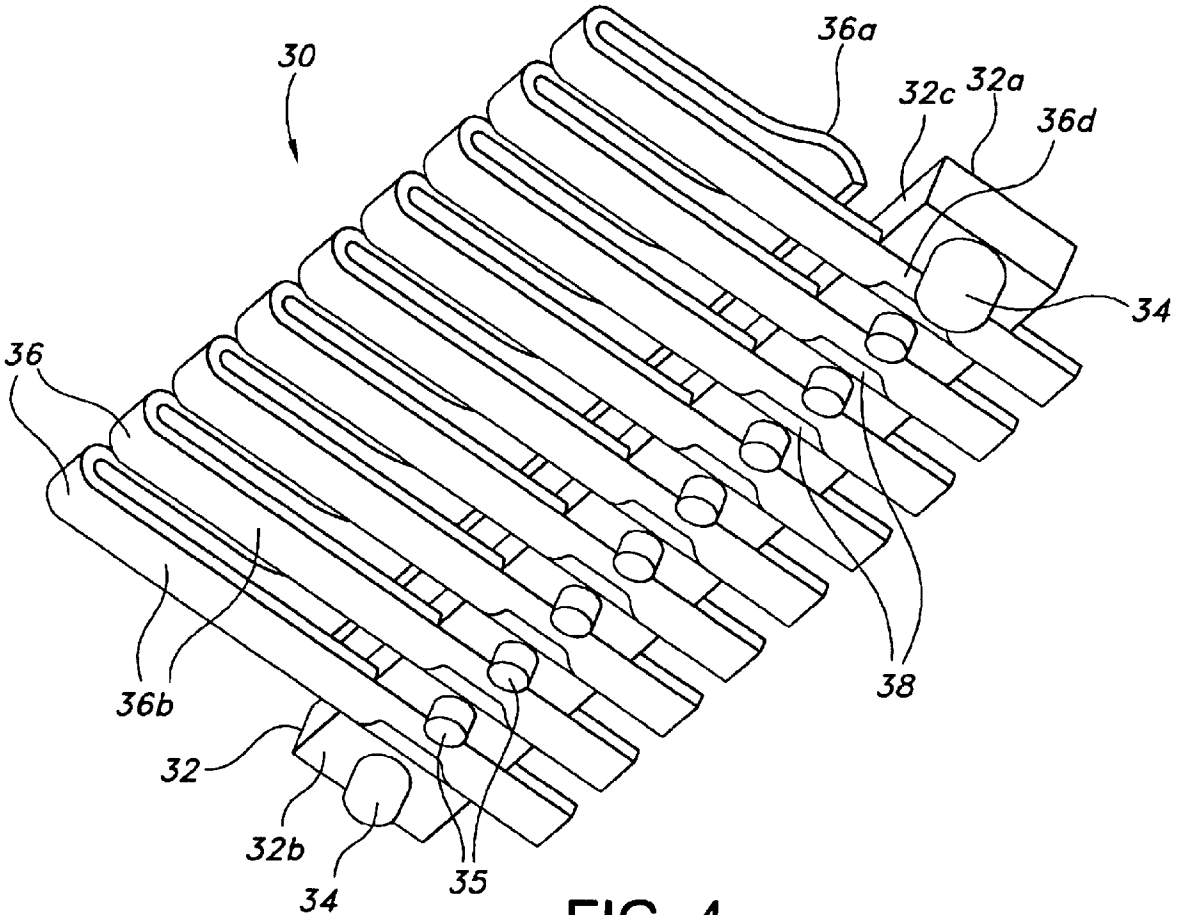
FIG. 4 shows a bottom perspective view of an alternate form of an LCD surface mount connector of the present invention.
Figure 5:
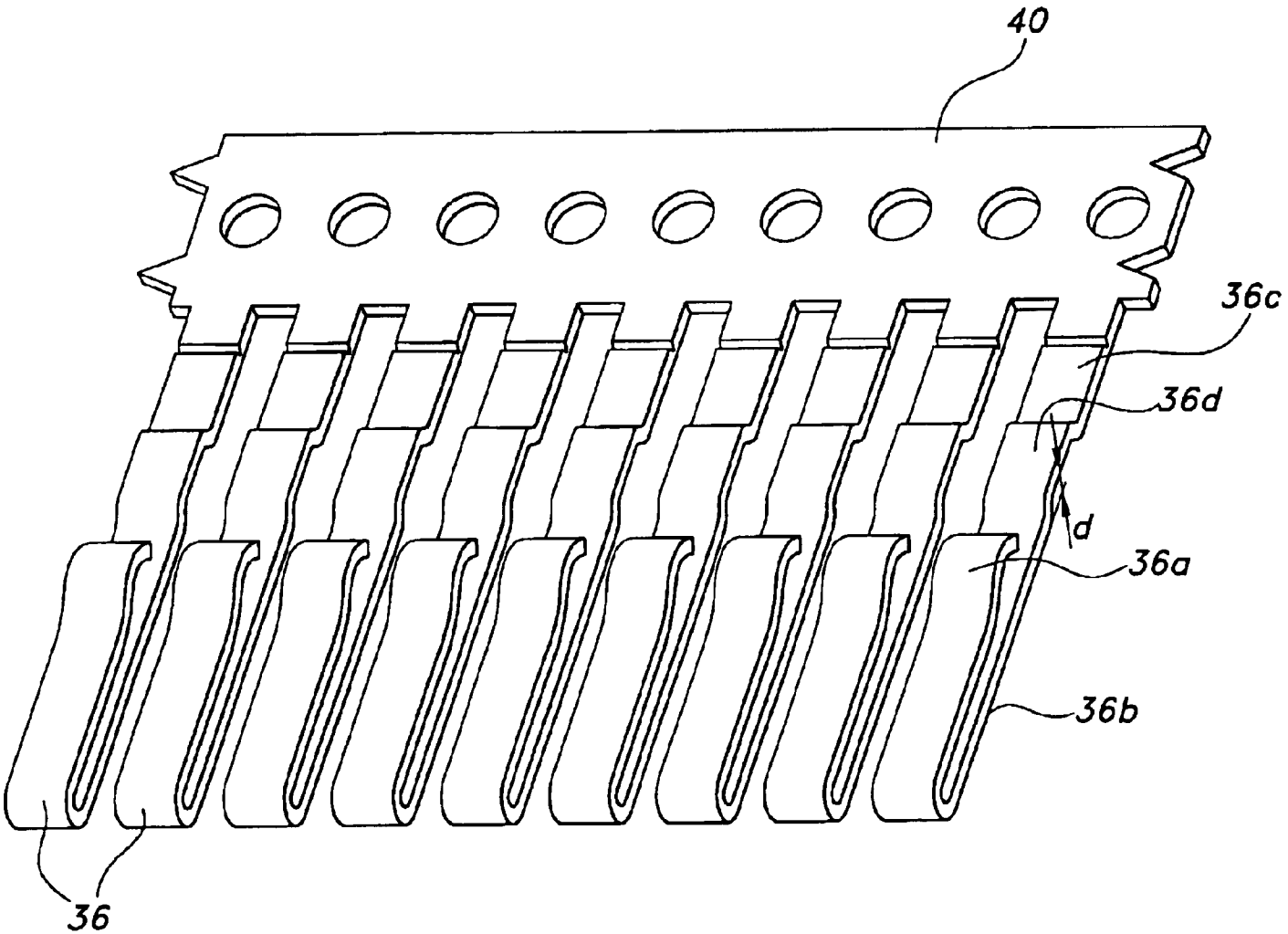
FIG. 5 shows a top perspective view of a plurality of contacts employed in the connector of FIG. 4 prior to coup ling of the contacts to a connector housing.

Now referring to FIGS. 4 and 5, an alternative LCD surface mount connector 30 is provided which has a housing 32 with a substantially planar top surface 32*a*, a parallel bottom surface 32*b* and a peripheral side wall 32*c* bounded therebetween. Like pier 12 of connector 1, one or more securement members 34 protrude normally from bottom surface 32*b* for alignment and securement with correspondingly configured apertures in a PWB. A plurality of cold-staked posts 35 also depend normally from bottom surface 32*b* so as to be linearly spaced relative to one another. Housing 32 is desirably fabricated from an insulative plastic material.

Connector 30 further includes a plurality of contacts 36 that are stamped from a common ribbon 40 of a conductive metallic material as shown in FIG. 5. Contacts 36 are similar to contacts 16, having a spring-like undulation 36*a* extending in spaced linear relation to a co-terminal base 36*b* and a tail portion 36*c* that protrudes normally from side wall 32*c* in an opposing direction relative to base 36*b*. Each contact 36 further includes a mid-section 36*d* elevated by a distance d above a plane in which base 36*b* and tail portion 36*c* lie.

Contacts 36 are coupled with housing 32 so that the contacts are alternatingly disposed in housing 32 relative to posts 35 (as shown in FIG. 4). Contacts 36 are fitted into correspondingly configured recesses 38 in housing 32 so as to establish a friction fit therewithin. Contacts 36 may also be retained in housing 32 by any other appropriate coupling means, such as adhesive or the like. Posts 35 may alternatively be swaged over contacts 36 so as to ensure alignment and securement thereof.

Figure 6:
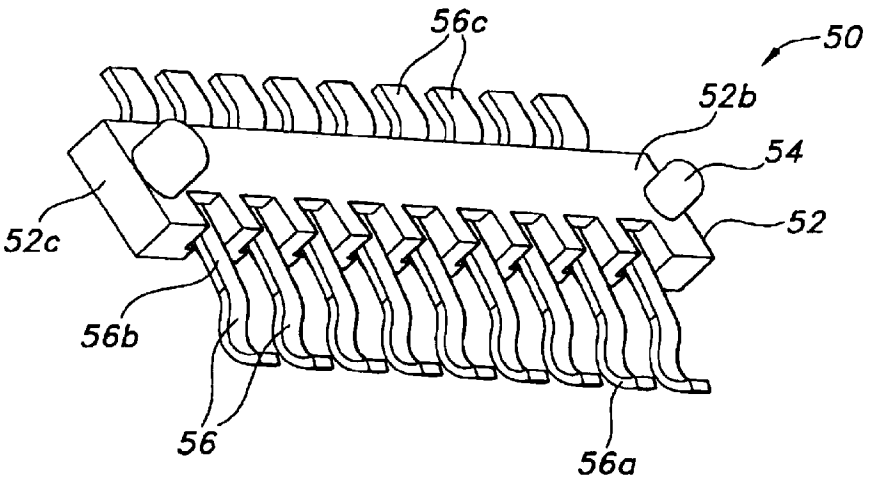
FIGS. 6 and 6A show a bottom perspective view and a top perspective view, respectively, of another alternative form of an LCD surface mount connector of the present invention having press fit contacts mounted in an insulative housing.
Figure 6A:
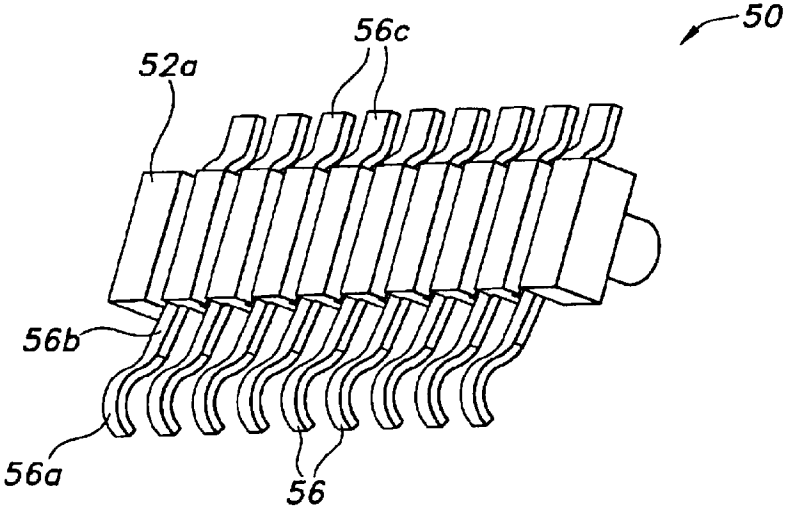

An alternate form of the LCD surface mount connector of the present invention is further illustrated in FIGS. 6 and 6A. Connector 50 includes an insulative housing 52 having a top surface 52*a*, a bottom surface 52*b* and peripheral said walls 52*c* bound therebetween. Housing 52 includes one or more securement members 54 depending normally from bottom surface 52*b*.

Figure 7:
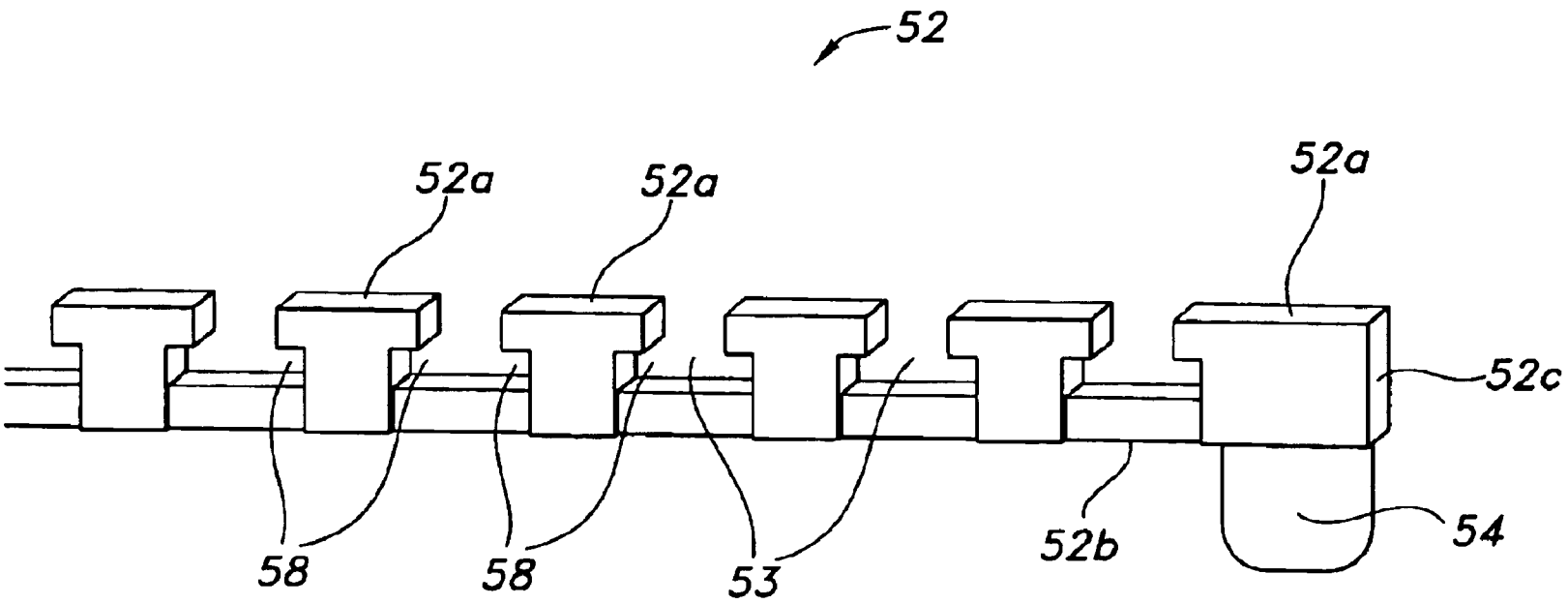
FIG. 7 shows a front perspective view of an insulative housing having slots for retention of contacts therein.

As further illustrated in FIG. 7, upper surface 52*a* is alternatingly interrupted by contact insertion cavities 53 having contact insertion recesses 58 defined on either side thereof. Recesses 58 provide sufficient space for press fit insertion of a contact 56 therewithin. Cavities 53 further provide sufficient open space to accommodate flexing of a contact extent thereinto upon engagement of the contact with corresponding conductive portions of the LCD.

Figure 8:
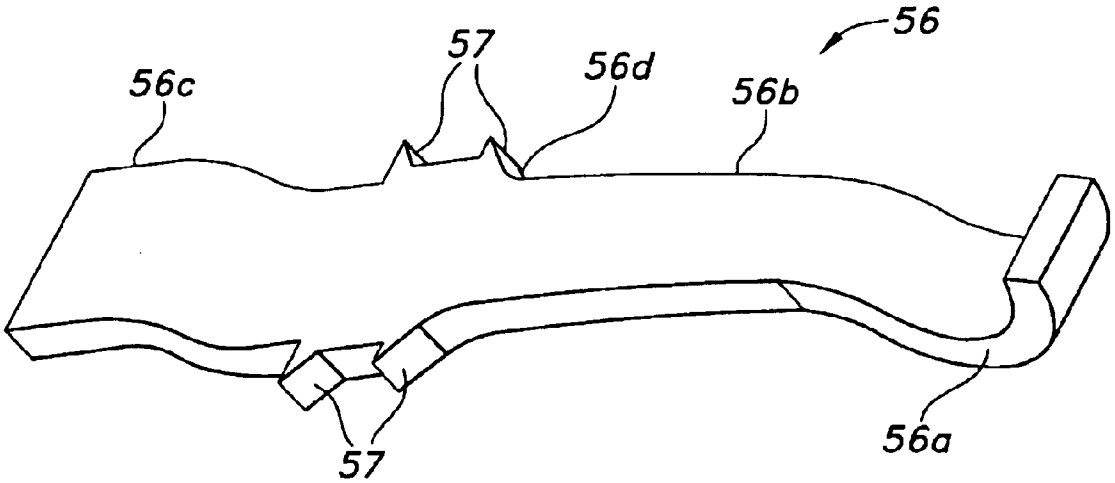
FIGS. 8 and 8A show top and bottom perspective views, respectively, of a barbed contact employed in the connector of FIGS. 6 and 6A.
Figure 8A:
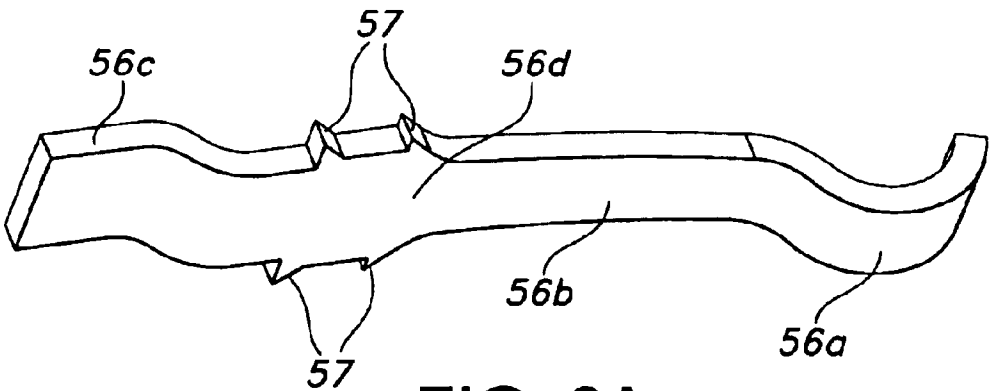
Figure 9:
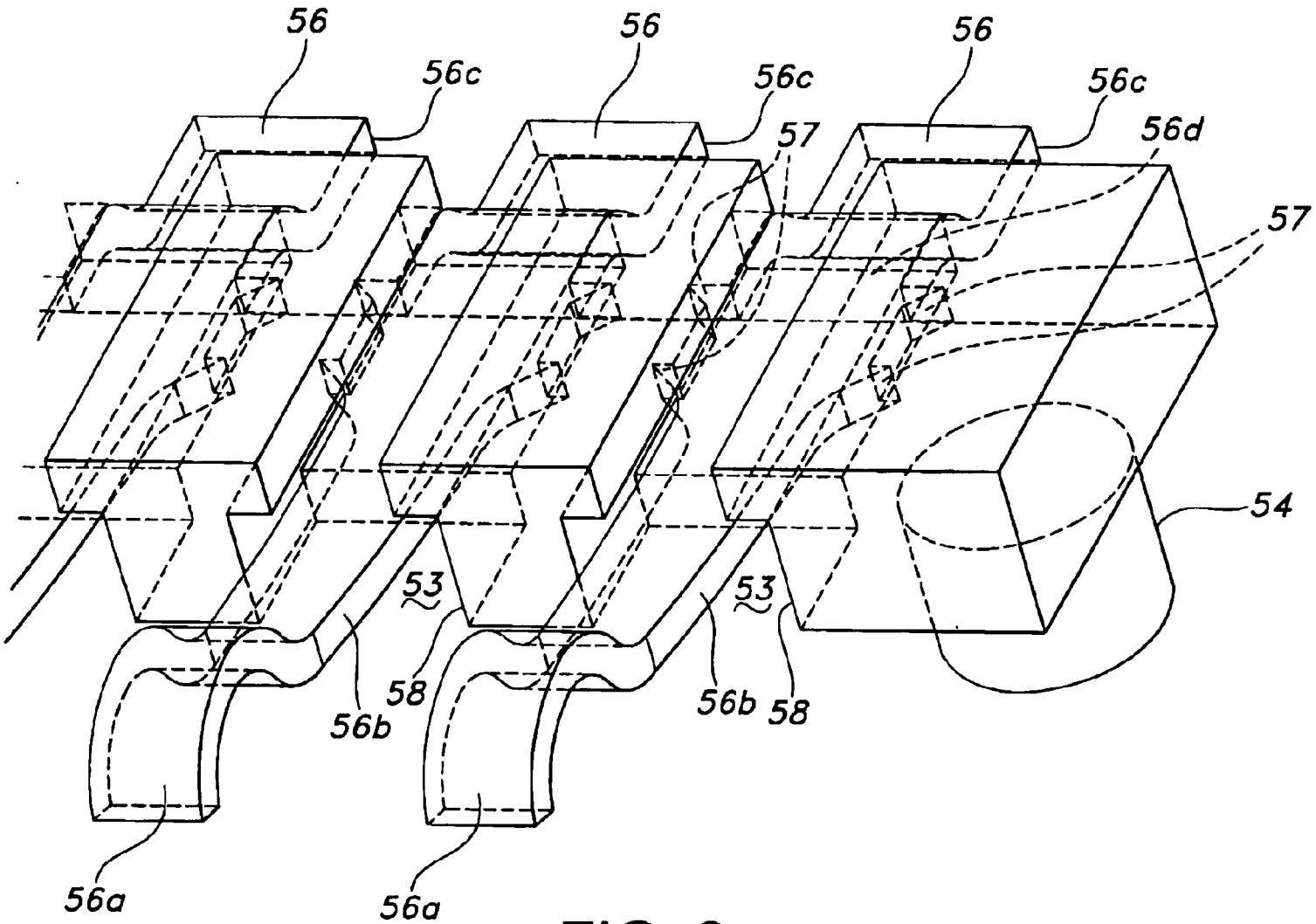
FIG. 9 shows an exploded view of a portion of the connector of FIGS. 6 and 6A having the contact of FIGS. 8 and 8A embedded therein

Referring to FIGS. 8 and 8A, contacts 56 used in connector 50 are cantilever style press fit contacts formed from a conductive metal material. Each contact includes a spring-like undulation 56*a* at an extent thereof which depends from a planar base 56*b*. A tail portion 56*c* is defined at an opposite extent of each contact, which tail portion extends from housing 52 in a direction opposite to that from which base 56*b* extends. Each contact 56 further includes a midsection 56*d* whereupon one or more barbs 57 are defined. Barbs 57 are insertably accommodated within recesses 58 to provide a friction or press fit between barbs 57 and housing 52. FIG. 9, which shows an exploded view of the circled portion of FIG. 6A, illustrates how a wall portion of housing 52 defined within recess 58 catches barbs 57 so as to retain contacts 56 therewithin.

Figures 10, 10A:
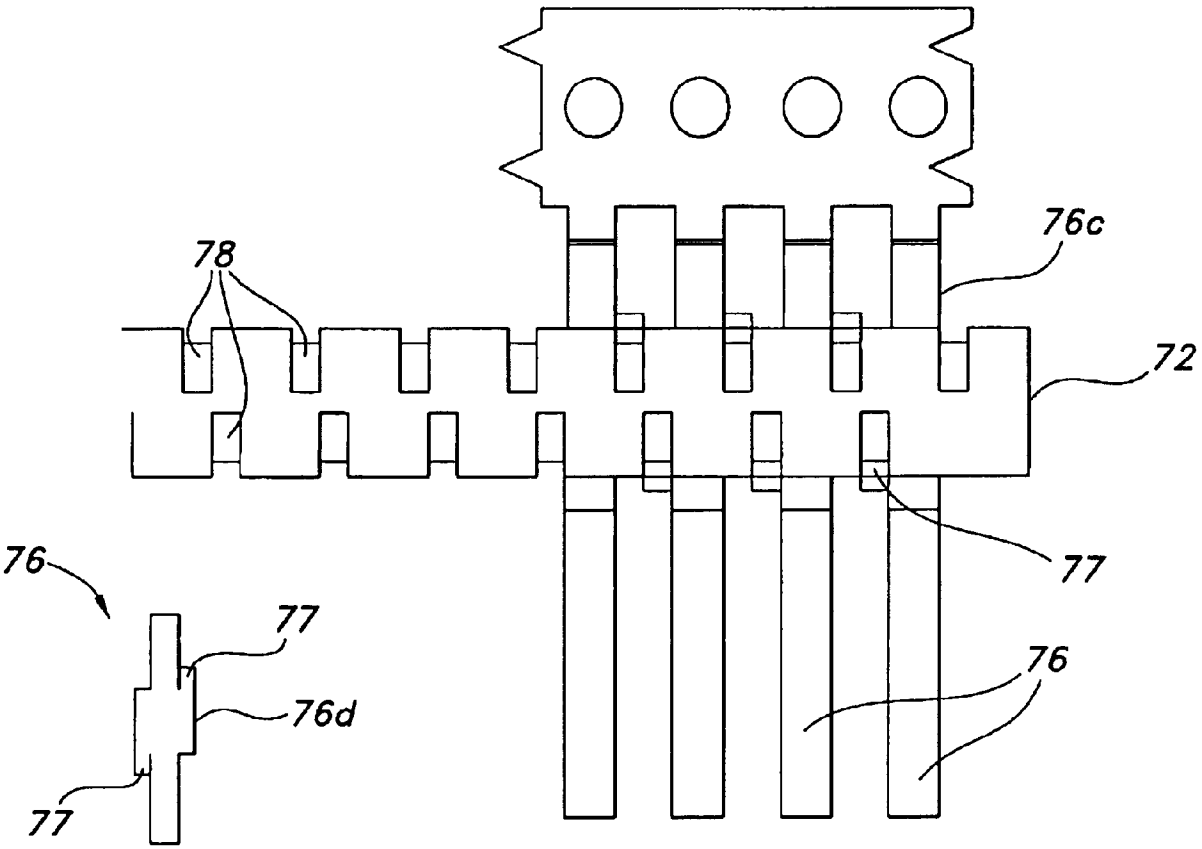
FIG. 10 shows a top plan view of an alternate preferred embodiment of an LCD surface mount connector of the present invention having contacts with portions bendable about an insulative housing for attachment thereto.
FIG. 10A shows a contact of the connector of FIG. 10 having bendable portions defined thereon.
Figure 11:
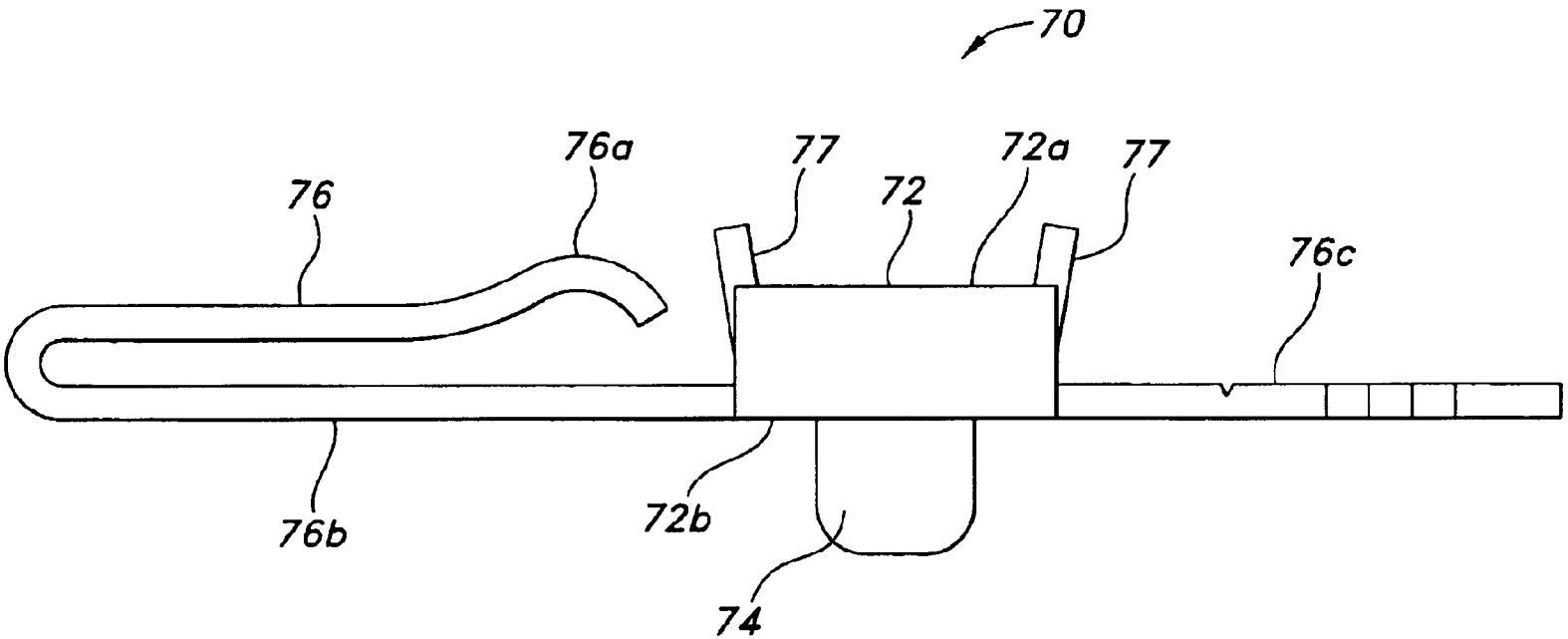
FIG. 11 is a side view of the connector of FIG. 10.
Figure 12:
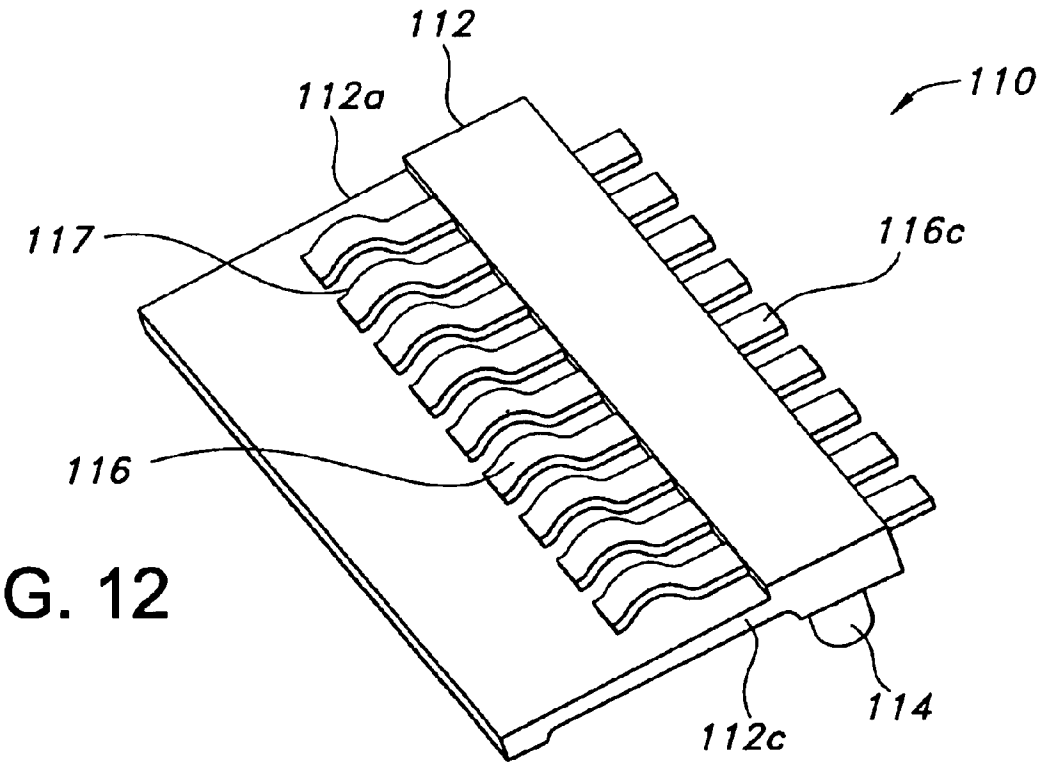
FIG. 12 shows a top perspective view of a further embodiment of an LCD connector of the present invention.

Another alternate form of the LCD surface mount connector of the present invention is shown in FIGS. 10 and 11. Similar to the previously described connectors, an LCD surface mount connector 70 has an insulative housing 72 supporting a plurality of conductive metal contacts 76 thereby. Housing 72 has upper and lower surfaces 72*a* and 72*b*, respectively, having a peripheral side wall 72*c* defined therebetween. Housing 72 further includes alternatingly disposed and laterally spaced recesses 78 that accommodate flexing of a contact portion therein as described further hereinbelow.

A contact 76 that is used in connector 70 is further shown in FIGS. 10*a* and 11. Connector 76 has a deflectable spring-like undulation 76*a* at an extent thereof which depends from a generally planar base 76*b*. A tail portion 76*c* is defined at an opposite extent of contact 76 wherein tail 76*c* protrudes from side wall 72*c* in a direction opposite that of base 76*b*. Contact 76 further includes a mid-section 76*d* having bendable tines 77 defined thereon. Tines 77 are folded bendable in a staple-like fashion within recesses 78 of housing 72 so as to effect secure engagement therewith.

In another arrangement of the present invention shown with respect to FIGS. 12–16A, the connector utilizes a flexible connector housing supporting a plurality of alternatingly and laterally spaced contacts thereby. Each contact is a generally planar member having a resiliently deflectable undulation at an extent thereof wherein each undulation has a contact point that establishes mechanical an electrical engagement with a mating component in an LCD cell. The housing itself is used as a spring member that exerts a spring force against the mating component so as to achieve high normal forces while maintaining a low connector profile.

Figure 13:
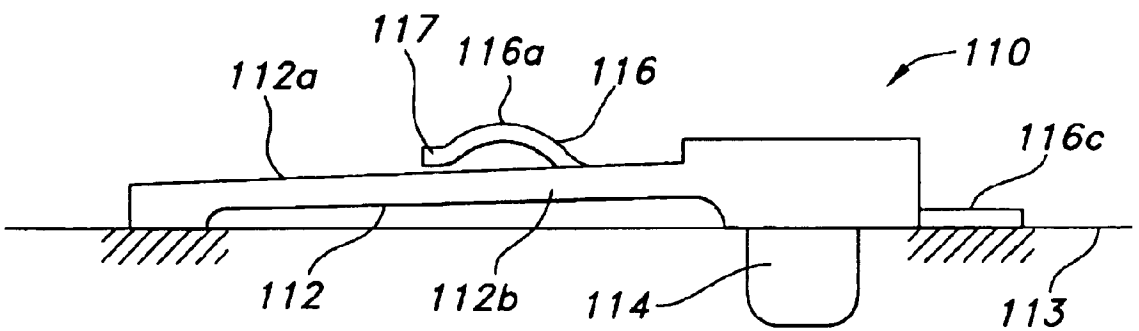
FIG. 13 shows a side view of the LCD surface mount connector of FIG. 12 as supported by a PCB.
Figure 14:
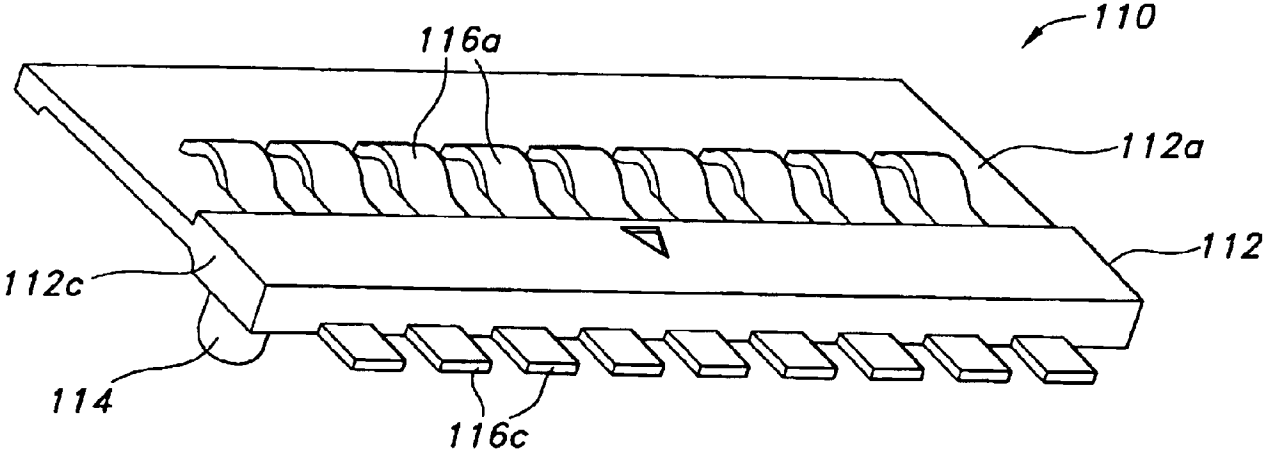
FIGS. 14 and 14A show top and bottom perspective views, respectively, of the connector of FIGS. 12 and 13.
Figure 14A:
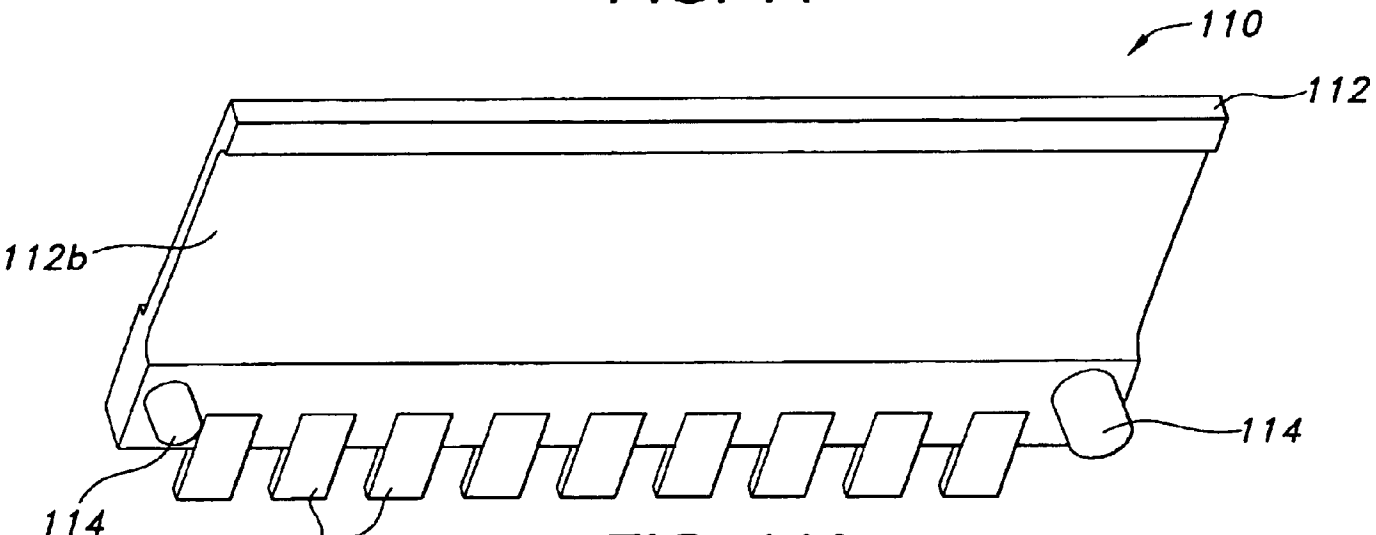

Now referring to the drawing figures, FIGS. 12 to 14A show an LCD connector 110 of the present invention that is securable to a PCB 113 (shown in FIG. 13). Connector 110 includes a housing 112 having a top planar surface 112*a*, a bottom planar surface 112*b* and a peripheral sidewall 112*c* extending therebetween. Connector 110 further includes one or more securement members 114 depending normally from bottom surface 112*b* to effect securement of connector 110 to a correspondingly configured aperture in PCB 113. Housing 112 is desirably fabricated from an insulative plastic which is easily molded such as by RTM or injection molding processes.

Housing 112 supports a plurality of laterally spaced contact 116 thereby. As further shown in FIGS. 12 and 13, each contact 116 includes a resiliently deflectable spring-like undulation 116*a* that lies in parallel spaced relation to top surface 112*a*. Each undulation has a contact point 117 defined thereon which establishes the site of contact with a mating component as shown in FIG. 13. Each contact 116 further includes a tail portion 116*c* that protrudes from a portion of sidewall 112*c* opposite that from which undulation 116*a* extends. Tail portion 116*c* enables termination of the connector with PCB 113.

Contacts 116 are desirably assembled with housing 112 by performing an insert mold operation wherein housing 112 is directly molded around the contacts. In the alternative, contacts 116 may be press fit into correspondingly configured cavities in housing 112 so as to effect frictional engagement therewith. Such engagement may be achieved with or without the use of an adhesive or the like. Contacts 116 are thereby retained in alignment relative to one another and relative to pier 112 so as to effect sufficient aligned connection with requisite conductive elements on the LCD display and the PCB.

Housing 112 desirably retains a flexible condition wherein the housing itself acts as a leaf spring when connection therewith is established by a mating component. The top and bottom planar surfaces 112*a* and 112*b* respectively are substantially flexible. As the component exerts a downward force toward PCB 113, the housing planar portions 112*a* and 112*b* predictably exerts an upward force in response thereto, which is normal to contact point 117. Such normal force further ensures reliable contact between connector 110 and a mating component in engagement therewith.

Figure 15:
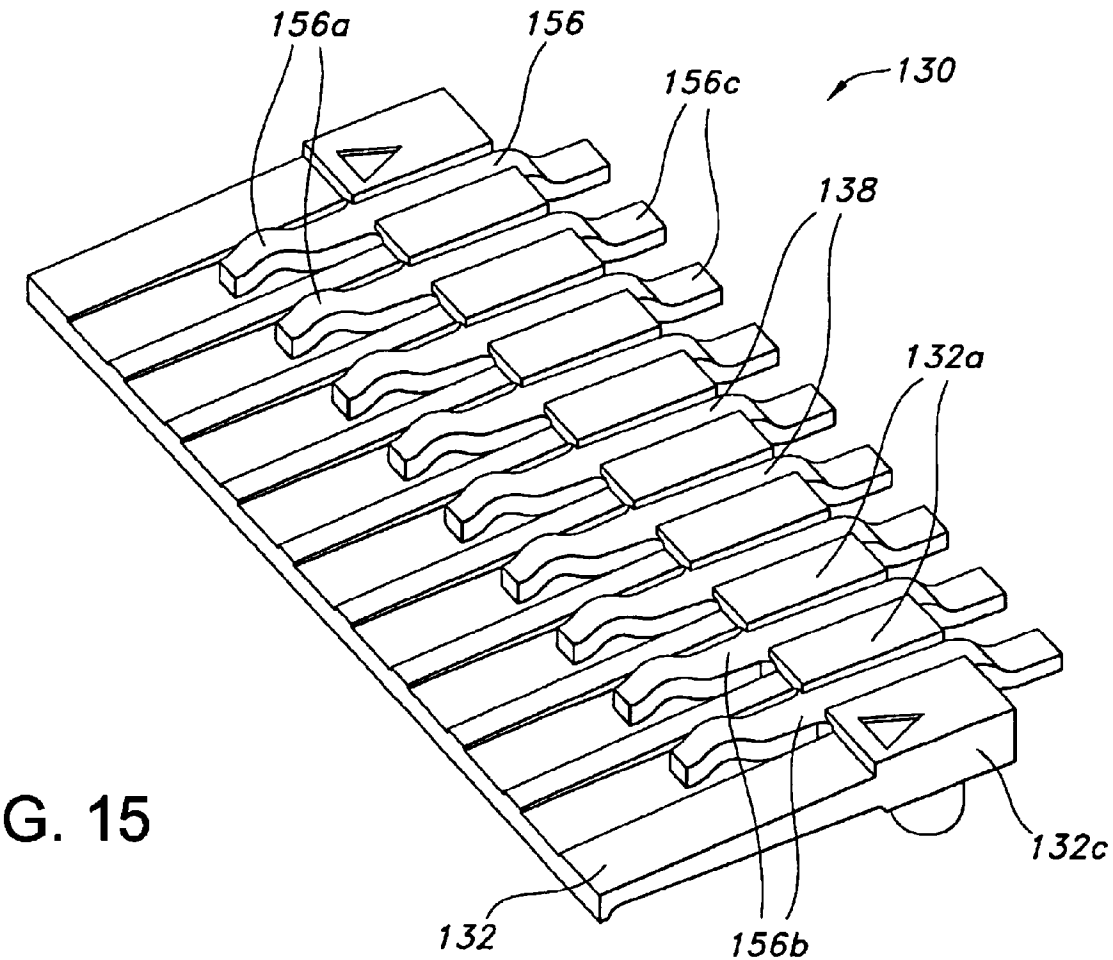
FIGS. 15 and 15A show top and back perspective views, respectively, of an alternate preferred embodiment of the LCD connector of the present invention.
Figure 15A:
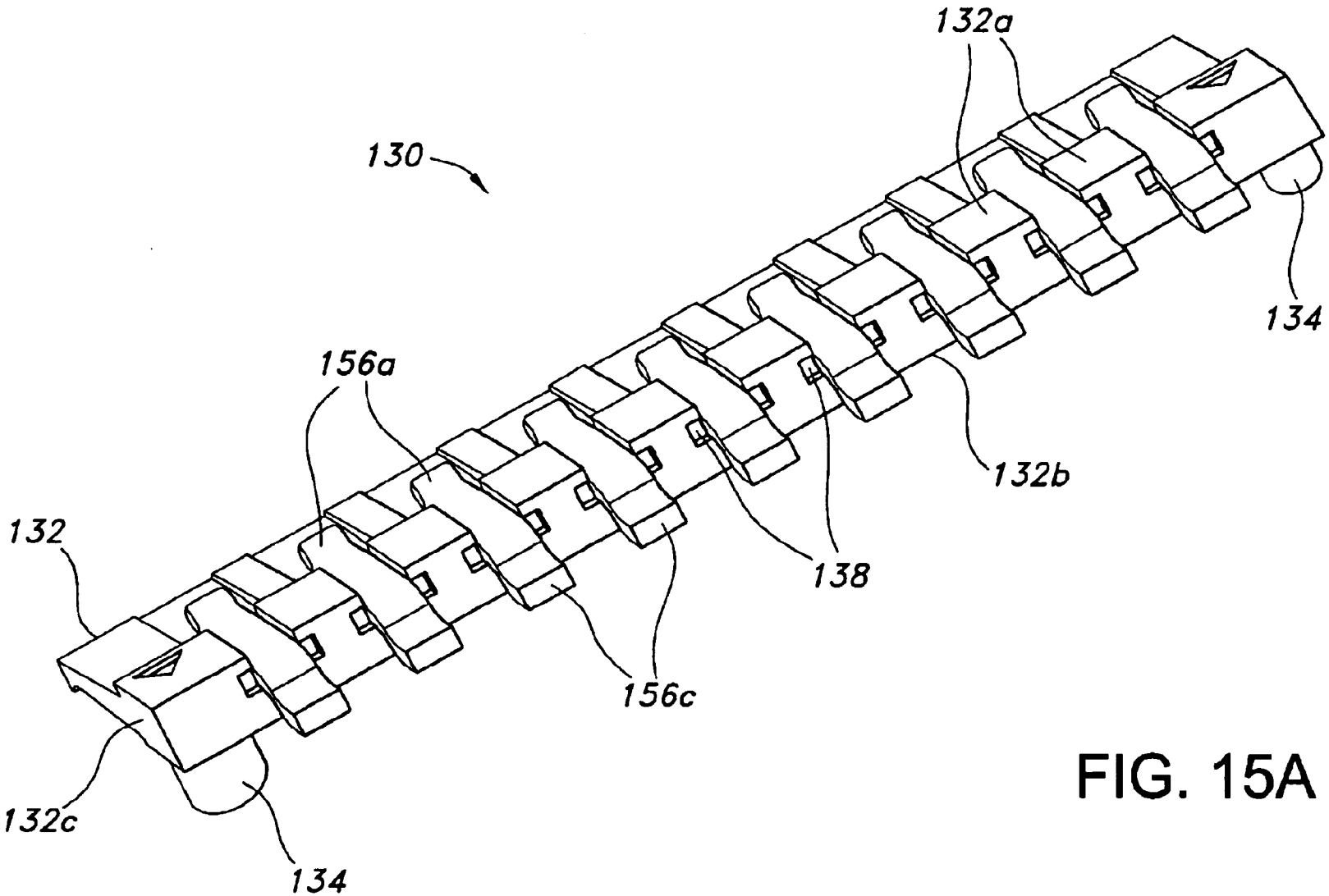

Now referring to FIGS. 15 and 15A, another alternate form of an LCD connector of the present invention is shown.

Connector 30 also includes a flexible housing 132 having an upper surface 132*a*, a lower surface 132*b* parallel thereto and a peripheral sidewall 132*c* defined therebetween. Connector 130 defines a plurality of recesses 138 therewithin which alternatively accommodate a corresponding plurality of laterally spaced contacts 156 therein.

Figure 16:
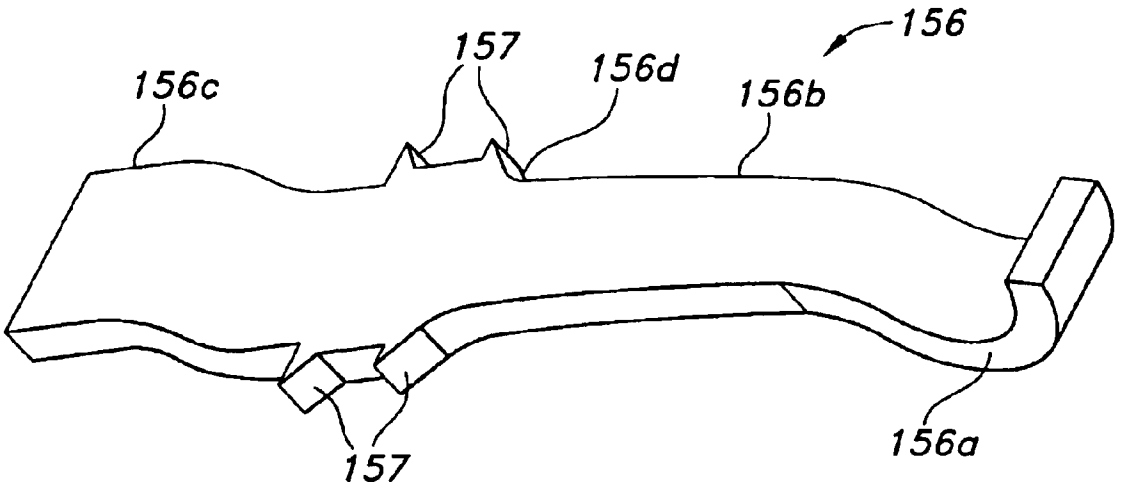
FIGS. 16 and 16A show top and bottom perspective views, respectively, of a contact used in the connector of FIGS. 15 and 15A.
Figure 16A:
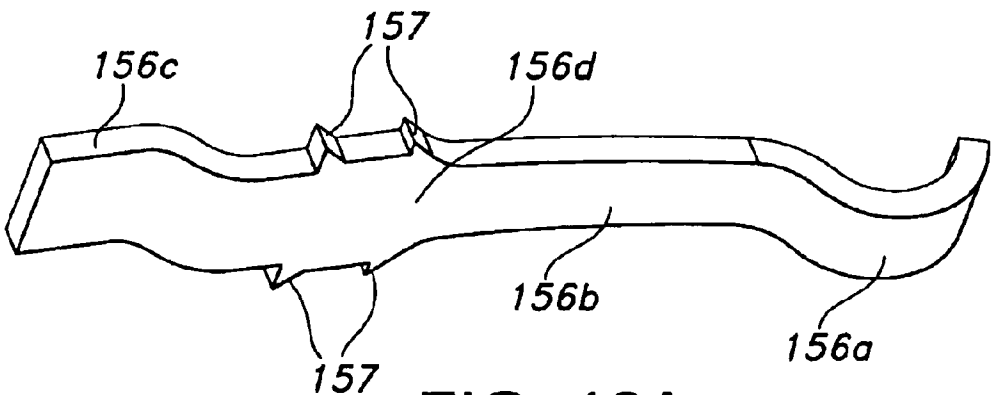
Figure 17:
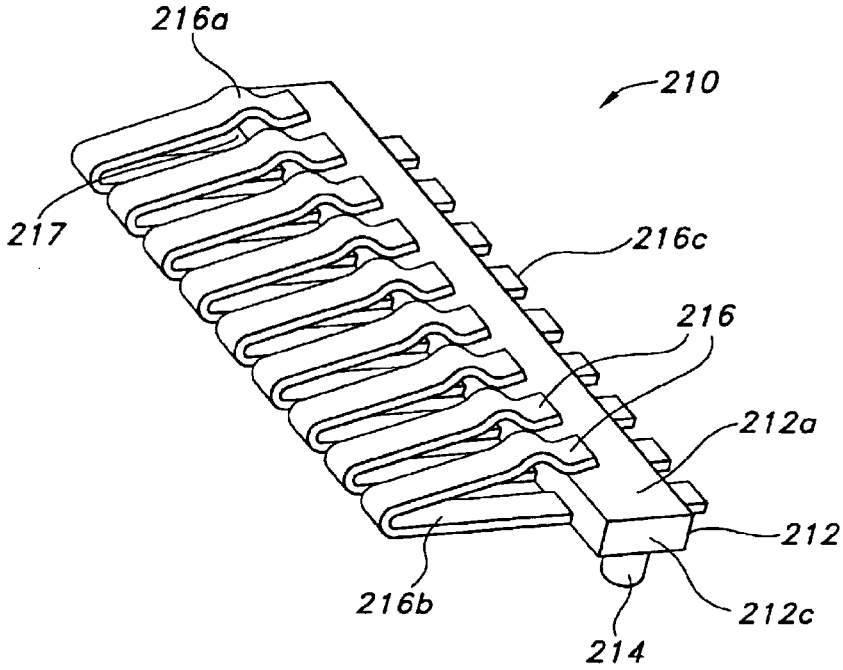
FIG. 17 shows a top perspective view of another embodiment of an LCD connector of the present invention.
Figure 17A:
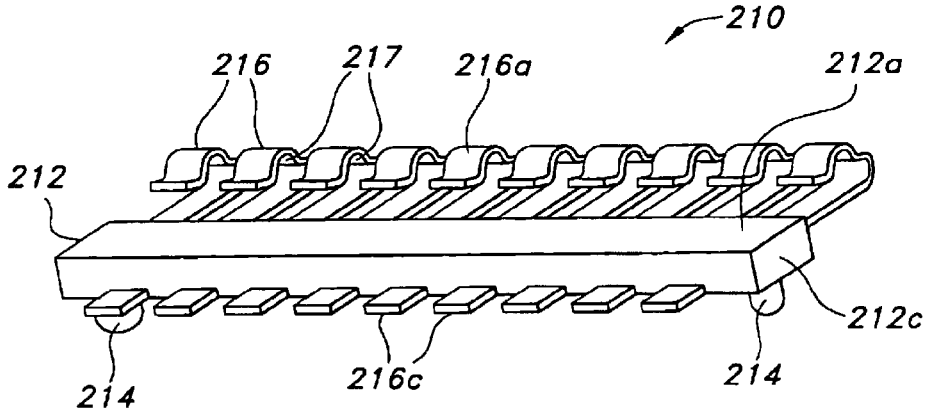
FIG. 17A shows a front perspective view of the LCD surface mount connector of FIG. 17.
Figure 18:
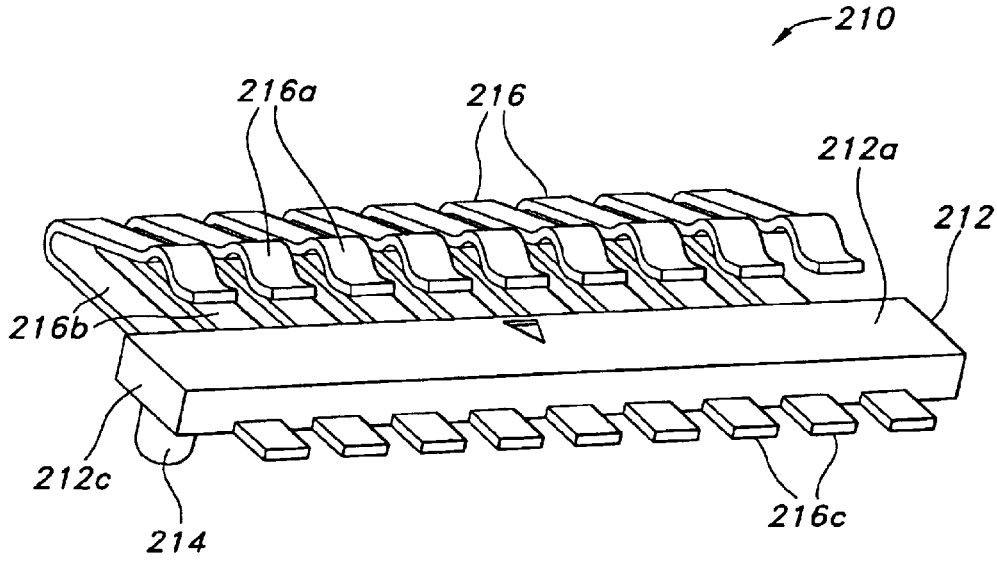
FIGS. 18 and 18A show alternate front and top perspective views, respectively, of the connector of FIGS. 17 and 17A.
Figure 18A:
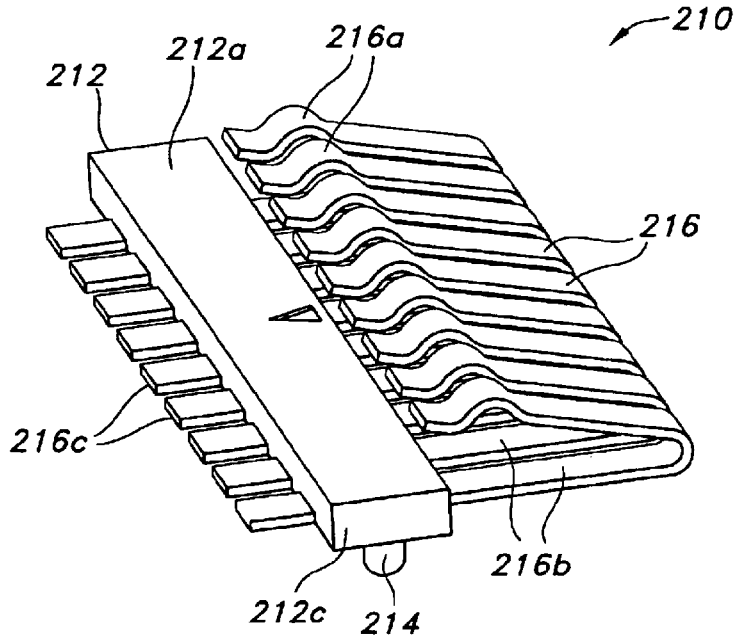
Figure 19:
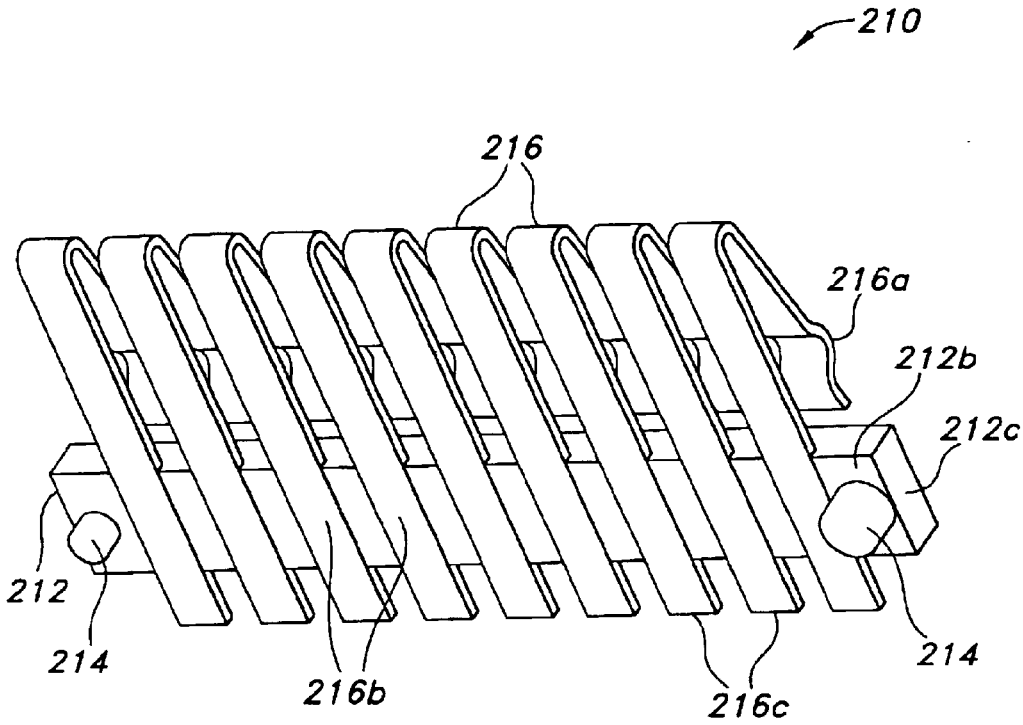
FIG. 19 shows a bottom perspective view of the connector of FIGS. 17 and 17A and FIGS. 18 and 18A.
Figure 20:
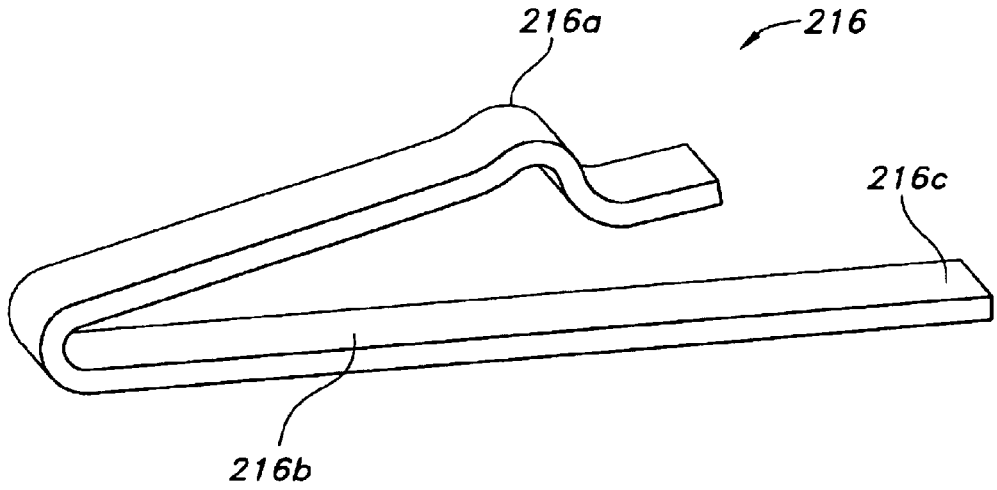
FIG. 20 shows a contact used in the connector of FIGS. 17–19 prior to preloading at a deflectable extent thereof.
Figure 21:
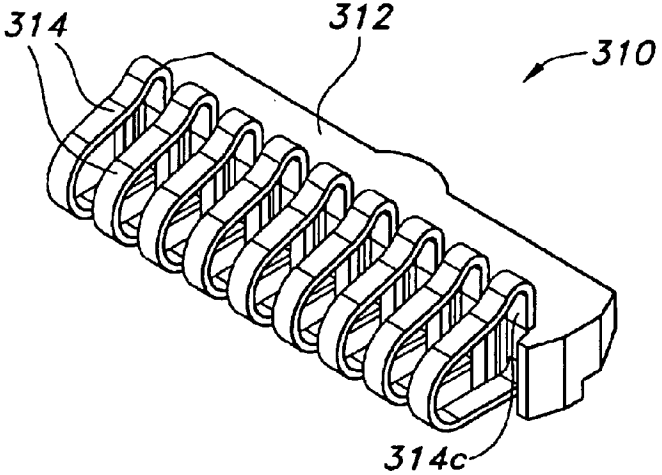
FIG. 21 is a top perspective view of yet a further embodiment of a LCD connector of the present invention.
Figure 22:
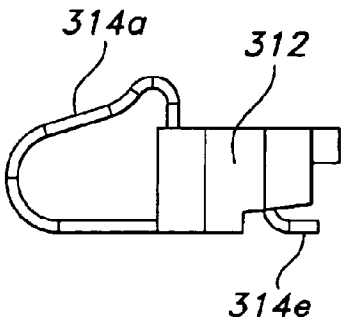
FIG. 22 shows a side elevation view of the LCD connector of FIG. 21.
Figure 24:
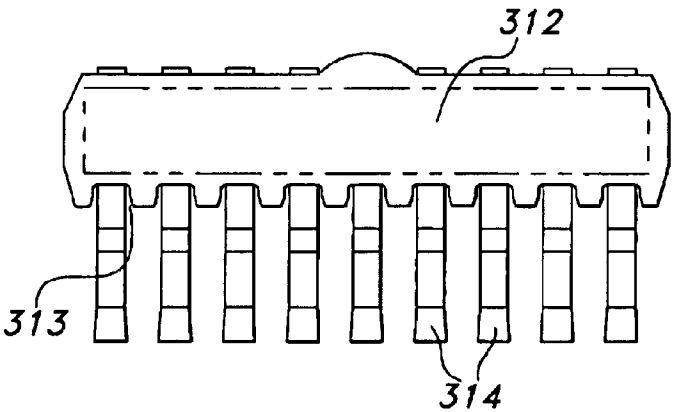
FIG. 24 is a top plan view of the LCD connector shown in FIG. 21.
Figure 23:
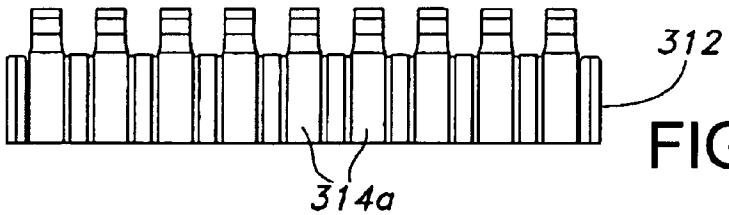
FIG. 23 is a front elevation view of the LCD connector shown in FIG. 21.
Figure 25:
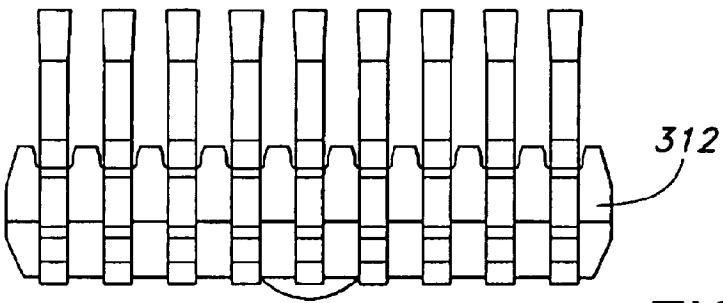
FIG. 25 is a bottom plan view of the LCD connector shown in FIG. 21.
Figure 26:
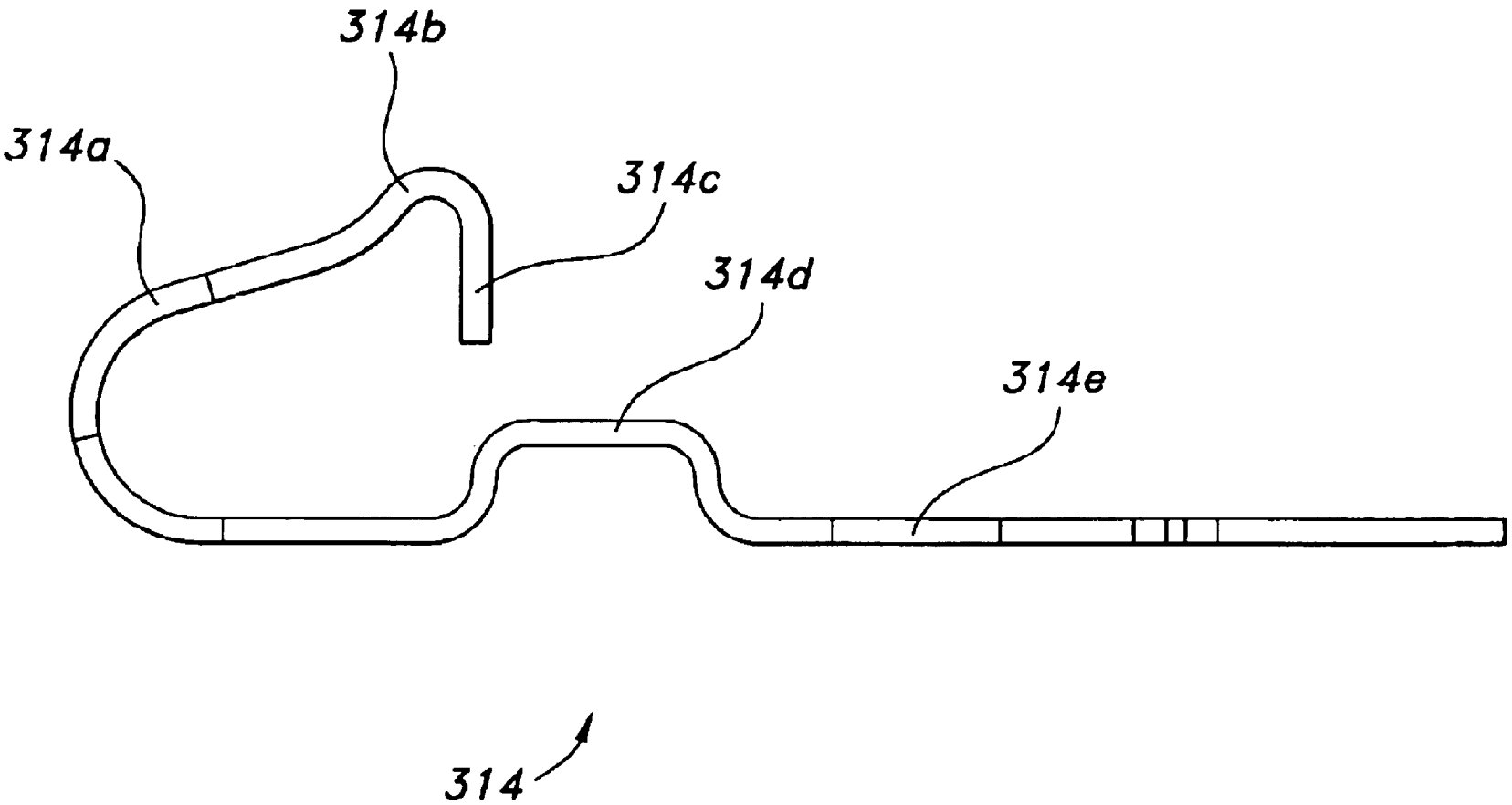
FIG. 26 is an enlarged side view of one of the contacts contained in the LCD connector of FIG. 21.

As further shown in FIGS. 16 and 16A, contacts 156 are generally planar members having a deflectable, spring-like undulation 156*a* at an extremity thereof that terminates a base portion 156*b*. A tail portion 156*c* is defined at an opposite extent of contact 156 for termination to a PCB. Contacts 156 are desirably press fit into cavities 138 and may be secured therewithin by one or more barbs 157 depending from a midsection 156*d* thereof. Securement of the contacts to the housing may also be effected by other well-known means.

In a further arrangement of the present invention shown in FIGS. 17–20, the connector utilizes a plurality of contacts having a clothespin type configuration wherein a deflectable extent of the contact may be spring loaded to withstand normal forces applied thereto. The contacts are easily assembled with an insulative connector housing such that assembly of the housing ad contacts effects alignment of the contacts and ensures proper mechanical and electrical engagement between the contacts and corresponding pads on the conductive portions of the LCD and the PWB.

Now referring to the drawing figures, FIGS. 17 to 20 show an LCD connector 210 of the present invention. Connector 210 includes a housing 212 having a top planar surface 212*a*, a bottom planar surface 212*b* and a peripheral sidewall 212*c* extending therebetween. Connector 210 further includes one or more polarizing retention pegs 214 protruding normally from bottom surface 212*b* to effect securement of connector 210 to a correspondingly configured aperture in a PCB. Housing 212 is desirably fabricated from an insulative plastic which is easily molded such as by RTM or injection molding processes.

Housing 212 supports a plurality of laterally spaced contacts 216 thereby. As further shown in FIG. 20, each contact 16 is provided in a clothespin-type configuration wherein a spring-like undulation 216*a* lies in parallel spaced relation to a substantially planar base 216*b* to define a preload window 217 therebetween. Preload window 217 sustains the undulation in a pre-loaded condition so as to withstand elevated normal forces thereon and maintain a low connector profile. Each contact 216 further includes a tail portion 216*c* that protrudes from a portion of sidewall 212*c* opposite that from which base 216*b* extends.

Contacts 216 are desirably assembled with housing 212 by performing an insert mold operation wherein housing 212 is directly molded around the contacts. In the alternative, contacts 216 may be press fit into correspondingly configured cavities in housing 212 so as to effect frictional engagement therewith. Such engagement may be achieved with or without the use of an adhesive or the like. Contacts 216 are thereby retained in alignment relative to one another and relative to pier 212 so as to effect sufficient aligned connection with requisite conductive elements on the LCD display and the PWB.

In yet a further arrangement of the present invention shown in FIGS. 21–26, the connector utilizes a plurality of spring contacts that are laterally spaced in an insulative connector housing. The contacts can have resilient undulation spring-like portions at a looped extent thereof and a tail portion for termination with a PWB. The contacts are fabricated for easy coupling with the housing wherein coupling effects alignment of the contacts and ensures proper mechanical and electrical engagement between the contacts and corresponding pads on the conductive portions of the LCD and the PWB.

Now referring to the drawing figures, FIGS. 21–26 show an LCD connector 310 of the present invention that is securable to a PCB (not shown). Connector 310 includes an insulative housing 312 supporting a plurality of contacts 314 that are laterally spaced in the housing 312. Each of the contacts 314 has a front resilient undulation spring-like portion defined by a loop extent 314*a*. Each of the looped extents 314*a* comprises an upper contact point 314*b* for making engagement to an LCD. Contact portions 314*b* terminate in downwardly projecting extents 314*c* which are suitably contained within a slot 313 in insulative housing 312 for captive movement upon connection with an LCD. Electrical contacts 314 include intermediate mid-sections 314*d* for fixed securement to insulative housing 312. Each electrical contact terminates at its rear portion in a tail 314*e* for electrical connection with a printed wiring board. The mid-section 314*d* is offset from the plane of tail 314*e*.

Contacts 314 are desirably assembled within housing 312 by performing an insert mold operation wherein housing 312 is directly molded around the contacts 314. In the alternative, contacts 314 may be pressed fit into correspondingly configured cavities in the housing 312 so as to effect frictional engagement therewith. Contacts 314 are thereby retained in alignment relative to one another so as to effect sufficient aligned connection with requisite conductive elements on the LCD display and the PWB.

While the particular embodiments of the present invention have been shown and described, it will be obvious to those skilled in the art that changes and modifications may be made without departing from the fundamental teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An electrical connector for establishing electrical connection between a conductive portion of an LCD display and conductive elements of a printed circuit board, comprising:

a substantially planar integrally formed connector housing supportable on said printed circuit board, said housing having an upper surface, a lower surface and a peripheral wall; and a plurality of electrical contacts supported by said housing wherein each contact includes an interior contact extent having a flat portion and a deflectable spring-like portion defined thereat, wherein said spring-like portion overlies the flat portion, said interior contact extent provided for electrical engagement with said LCD conductive portion and an exterior contact extent for termination to said printed circuit board, and a mid-section extent between said interior contact extent and said exterior contact extent, said mid-section contact extent being secured to said lower surface of the housing allowing free connection of said exterior contact extent to said printed circuit board and deflectable connection of said interior contact extent to said LCD conductive portions, wherein a portion of said spring-like portion of each contact and a portion of each exterior contact extent lies in a common plane, said mid-sections of each contact being elevatedly offset with respect to said plane.

2. A connector according to claim 1, wherein said lower surface further comprises at least one securement member depending normally therefrom for engagement with a support surface for said connector.

3. A connector according to claim 1, wherein each said interior contact extent comprises a reversely bent deflectable spring-like portion terminating in a free end having an undulating contact portion.

4. A connector according to claim 1, wherein each said interior contact extent comprises a cantilevered deflectable spring-like portion terminating in a free end having an undulating contact portion.

5. A connector according to claim 1, wherein each said interior contact extent comprises a reversely bent deflectable spring-like portion terminating in a free end and having an undulating contact portion spaced from said free end.

6. A connector according to claim 1, wherein each said interior contact portion extent comprises a reversely bent portion defining a looped extent and terminating in a free end movably disposed within said housing and an undulating contact portion adjacent said free end.

7. A connector according to claim 1, wherein at least said exterior contact extent and said mid-sections of said contacts are not in the same plane.

8. A connector according to claim 1, wherein said housing is secured to said contact mid-sections by insert-molding.

9. A connector according to claim 1, wherein said mid-sections of said contacts each have an opening through which housing material flows for securement of said housing with said contacts.

10. A connector according to claim 2, wherein said housing further comprises a plurality of posts depending therefrom and spaced from each other.

11. A connector according to claim 10, wherein said posts are spaced substantially linearly with respect to each other.

12. A connector according to claim 1, wherein said housing is formed of moldable plastic.

13. An electrical connector for establishing electrical connection between a conductive portion of an LCD display and conductive elements of a printed circuit board, comprising:

a substantially planar integrally formed connector housing supportable on said printed circuit board, said housing having an upper surface, a lower surface and a peripheral wall; and a plurality of electrical contacts supported by said housing wherein each contact includes an interior contact extent having a flat portion and a deflectable spring-like portion defined thereat, wherein said spring-like portion overlies the flat portion, said interior contact extent provided for electrical engagement with said LCD conductive portion and an exterior contact extent for termination to said printed circuit board, and a mid-section extent between said interior contact extent and said exterior contact extent, said mid-section contact extent being secured to said lower surface of the housing allowing free connection of said exterior contact extent to said printed circuit board and deflectable connection of said interior contact extent to said LCD conductive portions, wherein said mid-sections of said contacts each comprise bendable tines for engageable securement with said housing.

* * * * *